US007442104B2

(12) United States Patent
Okabe

(10) Patent No.: US 7,442,104 B2
(45) Date of Patent: Oct. 28, 2008

(54) STEERING HANDLEBAR FOR OUTBOARD MOTOR

(75) Inventor: Yoshihiko Okabe, Hamamatsu (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 157 days.

(21) Appl. No.: 11/150,474

(22) Filed: Jun. 10, 2005

(65) Prior Publication Data

US 2006/0003644 A1 Jan. 5, 2006

(30) Foreign Application Priority Data

Jun. 10, 2004 (JP) ..... 2004-172428

(51) Int. Cl.
*B60W 10/04* (2006.01)

(52) U.S. Cl. ..... 440/86; 74/480 B; 440/53; 440/63

(58) Field of Classification Search ..... 440/84–87, 440/53, 62, 63; 74/480 B
See application file for complete search history.

(56) References Cited

U.S. PATENT DOCUMENTS 5,545,064 A * 8/1996 Tsunekawa et al. ..... 440/53
5,637,022 A * 6/1997 Koike et al. ..... 440/87
5,797,777 A * 8/1998 Tsunekawa et al. ..... 440/84
6,406,343 B2 * 6/2002 Kawai et al. ..... 440/86
6,902,450 B2 * 6/2005 Ohtsuki et al. ..... 440/63
2004/0106337 A1 6/2004 Okabe
2004/0121667 A1 6/2004 Okabe

FOREIGN PATENT DOCUMENTS

JP 10-218088 8/1998
JP 2000-272588 10/2000

* cited by examiner

*Primary Examiner*—Ed Swinehart
(74) *Attorney, Agent, or Firm*—Knobbe, Martens, Olson & Bear, LLP

(57) ABSTRACT

A tiller handle assembly for an outboard motor is provided that comprises a steering handle having a generally hollow body. A throttle grip is attached to a front end of the steering handle, and a shift mechanism coupled to the steering handle. The shift mechanism includes an moveable operator that can be moved at least between two positions: one of the positions corresponding to a drive operational mode of the outboard motor and the other position corresponding to a neutral operational mode of the outboard motor. A sensor device is disposed within the hollow body of the steering handle and is configured to determine whether the movable operator is positioned in one of the two position. The location of the sensor device within the hollow body makes mounting and maintenance of the sensor device easier and generally isolates the sensor device from water.

15 Claims, 6 Drawing Sheets

(A)

(B)

STEERING HANDLEBAR FOR OUTBOARD MOTOR

CROSS-REFERENCE TO RELATED APPLICATIONS

The present application is based on claims priority under 35 U.S.C. § 119(a)-(d) to Japanese Patent Application No. 2004-172428, filed on Jun. 10, 2004, the entire contents of which is expressly incorporated by reference herein.

BACKGROUND OF THE INVENTION

1. Field of the Invention

The present invention relates to a tiller handle assembly for operating an outboard motor, and more specifically to a tiller handle assembly for an outboard motor having a neutral switch mounted inside.

2. Description of the Related Art

Japanese Patent Publication No. Hei 10-218088 discloses an outboard motor with an engine, which is conventionally mounted to the stem of a small boat. Steering the watercraft is typically accomplished by turning the outboard motor. To control movement of the outboard motor, the watercraft can include a steering wheel and/or the outboard motor can include a tiller arm. The steering wheel is usually positioned in front of the operator's seat, and the tiller arm has a rod shape that is directly connected to the outboard motor. An operator operates the steering wheel or tiller arm to cause the outboard motor to swing toward the port or starboard sides to change the direction in which the boat moves.

Controlling functions such as shifting and accelerating are commonly accomplished by either a remote controller or by controls located on the tiller arm of the outboard motor. The tiller arm extends from the outboard motor, while the remote controller is disposed near an operator's seat (usually at a side of the operator's seat) in the boat. The controls, which are disposed at either of these locations, commonly include an operator to shift the outboard motor among operational modes (e.g., forward, neutral, and reverse) and an operator to control engine speed (and hence the propulsion thrust). In some applications, these operators are combined together (e.g., a single lever on a remote control unit).

In applications that use a shift lever, the shift lever is pivoted forward from a neutral position to a forward position to engage the engine with the propeller and to cause the propeller to rotate in a direction propelling the boat forward. To propeller the boat in reverse, the shift lever is pivoted rearward from the neutral position to a reverse position to engage the engine with the propeller and to cause the propeller to rotate in an opposite direction.

In this type of small boat, a neutral switch is commonly used to prevent starting the engine when the shift lever is at its forward or reverse position. The neutral switch detects the position of the shift lever and allows a start motor of the engine to operate only when the shift lever is at its neutral position. In the case of an outboard motor in which shift control of the engine is accomplished by a remote control (shift lever) at a side of the operator's seat away from the stem, the neutral switch is usually disposed in a remote controller. In applications where a tiller arm is used, the neutral switch is disposed within a cowling of the outboard motor.

Japanese Patent Publication No. 2000-272588 discloses an example of a tiller handle assembly for an outboard motor. The tiller handle assembly is attached to the outboard motor depending on user's needs. The outboard motor is rotated about a swivel shaft for steering with such tiller handle assembly. The tiller handle assembly has a steering handle body of a rod shape that is pivotally connected to the outboard motor and extends generally horizontally toward the inside of the boat. A throttle grip is attached to the front end of the steering handle body and is rotatable about its axis. Turning the throttle grip about the axis of the steering handle body controls opening and closing of a throttle valve and, hence, engine speed. Additionally, a shift lever, as described above, is attached to the tiller handle assembly.

As noted above, in applications employing a tiller handle assembly with a shift lever, the neutral switch is conventionally mounted to a shift mechanism located in the cowling of the outboard motor. Because the exact application of the outboard motor is not known at the time of its assembly, the tiller handle assembly is usually attached after the outboard motor has been shipped from the manufacturers factory. Accordingly, an after-factory worker (e.g., a dealer mechanic) typically installs the neutral switch within the outboard motor cowling.

Mounting the neutral switch to the outboard motor later and then wiring, however, is very complicated and troublesome work. Further, since the neutral switch is mounted to the completed outboard motor shipped from a plant, by a distributor or a user, mounting quality is less uniform than would it be if assembled during the production processes at the plant. Furthermore, the neutral switch mounted to the outboard motor has a different configuration from the neutral switch disposed in the remote control. This requires two types of neutral switches: one type for the remote control and one type for the outboard motor.

Additionally, because the outboard motor cowling is provided with an air intake for drawing air into the engine, some water typically enters inside of the outboard motor cowling. Thus, to mount the neutral switch in the outboard motor, the switch is required to be waterproof, resulting in a complicated structure and cost increase. In particular, a shift link mechanism, which is used to shift the operational mode of the outboard motor among forward, reverse, and neutral modes, is located at a lower portion in the cowling. Thus, the neutral switch for detecting the neutral position through operation of the shift link mechanism is also located adjacent to the shift link mechanism at the lower portion in the cowling. Water, which enters the inside of the cowling, tends to collect at the lower portion in the cowling. This requires a waterproof configuration, such as making the neutral switch itself waterproof or covering it with a waterproof cover. Either approach, however, increases cost and complicates the retrofit of the neutral switch onto the outboard motor.

A need therefore exists for an improved neutral switch for use a tiller handle assembly.

SUMMARY OF THE INVENTION

An aspect of the present invention involves a tiller handle assembly for an outboard motor that comprises an elongated steering handle having a longitudinal axis. The steering handle is configured to be pivotally connected to the outboard motor and to extend outward from the outboard motor. A throttle grip attaches to a front end of the steering handle and is rotatable generally about the longitudinal axis. A movable shift lever is provided to select an operational mode of the outboard motor among forward, neutral and reverse operational modes, and a neutral switch is disposed inside the steering handle. The neutral switch is arranged to determine at least when the shift lever lies in a position corresponding to the neutral operational mode for the outboard motor.

There are several advantages associated with locating the neutral switch within the steering handle body. If a purchaser elects to purchase an outboard motor with a tiller handle, an after-factory worker (e.g., a mechanic for a dealer) need not mount the neutral switch in the outboard motor. Therefore, quality in assembling and wiring of the neutral switch becomes consistent, and its reliability increases. Further, because the tiller handle is disposed inside the boat, there is a reduced chance of water entering the steering handle body in comparison to the outboard motor cowling. Thus, the enhanced water isolation improves the durability of the switch.

An additional aspect of the present invention involves a tiller handle assembly for an outboard motor that comprises a steering handle having a generally hollow body. A throttle grip is attached to a front end of the steering handle, and a shift mechanism coupled to the steering handle. The shift mechanism includes a moveable operator that can be moved at least between two positions: one of the positions corresponding to a drive operational mode of the outboard motor and the other position corresponding to a neutral operational mode of the outboard motor. A sensor device is disposed within the hollow body of the steering handle and is configured to determine whether the movable operator is positioned in one of the two position. The location of the sensor device within the hollow body makes mounting and maintenance of the sensor device easier and generally isolates the sensor device from water.

While certain aspects, features and advantages of the tiller handle assembly have been noted above, various embodiments of such need not provide all of the above-noted advantages and features.

BRIEF DESCRIPTION OF THE DRAWINGS

The preferred embodiment of the present tiller handle assembly for outboard motor, illustrating its features, will now be discussed in detail. This embodiment depicts the novel and non-obvious tiller handle assembly shown in the accompanying drawings, which are for illustrative purposes only. These drawings include the following figures, in which like numerals indicate like parts.

DETAILED DESCRIPTION OF THE PREFERRED EMBODIMENT

Figure 1:
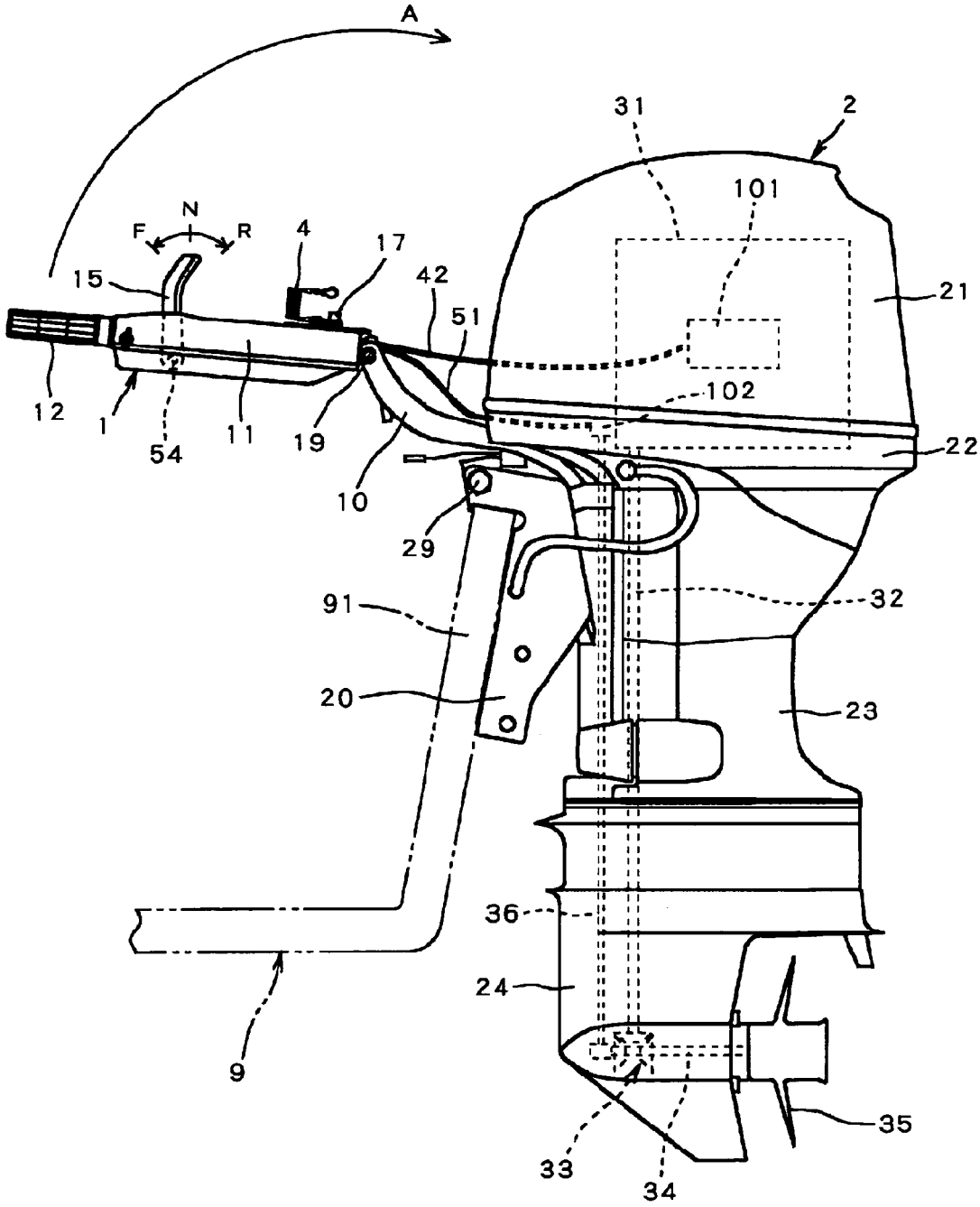
FIG. 1 is a side elevational view of an outboard motor with a tiller handle assembly configured in accordance with the preferred embodiment of the invention, with several internal components of the outboard motor shown in phantom.

FIG. 1 shows the overall configuration of an outboard motor 2 and a tiller handle assembly 1 according to the preferred embodiment of the present invention.

From top to bottom, the outboard motor 2 includes a propulsion device (e.g., an internal combustion engine) covered by an upper cowling 21, a lower cowling 22, an upper casing 23, and a lower casing 24. The outboard motor 2 is mounted to a transom plate 91 of a hull 9 through a clamp bracket 20.

A four-stroke engine 31, for example, is housed inside the upper cowling 21 and the lower cowling 22. Of course, the present tiller handle assembly 1 can be used with outboard motors having other types of engines that operate on other types of combustion principles. The illustrated engine 31 has a crankshaft (not shown) disposed in a direction generally perpendicular to the surface of water (i.e., generally vertically oriented). The crankshaft is connected to the upper end of a drive shaft 32. The drive shaft 32 vertically extends in the upper casing 23 and the lower casing 24, and its lower end is connected to a transmission or forward-reverse shifting gear mechanism 33, which includes a pair of counter-rotating forward and reverse bevel gears and a dog clutch. These gears and clutch are housed in the lower casing 24. A propeller shaft 34 extends horizontally from the gear mechanism 33. The gear mechanism 33 transmits rotational force from the drive shaft 32 about its vertical axis to the propeller shaft 34 through either of the forward and reverse bevel gears, after converting it to rotational force about a horizontal axis of the propeller shaft 34. A propeller 35 is mounted to an end of the propeller shaft 34 which projects outside the lower casing 24. Rotation of the propeller 35 underwater propels the hull 9.

In addition, the gear mechanism 33 is configured to change the rotational direction of the propeller shaft 34 in accordance with operation of a shift rod 36 so that the moving direction of the hull 9 changes between forward and reverse directions.

The outboard motor 2 itself is mounted onto the transom plate 91 in a manner that permits rotation of the outboard motor 2 about a tilt shaft 29 through a hydraulic mechanism, for example. This allows the operator to increase a tilt angle of the outboard motor 2 to lift it above the surface of water for docking and to adjust a trim angle of the outboard motor 2 to obtain optimum propelling force during operation of the boat.

The tiller handle assembly 1 generally has a rod-like shape and is attached to the outboard motor 2 through a steering bracket 10. The tiller handle assembly 1 extends generally horizontally toward the inside of the hull 9. The base end of the tiller handle assembly 1 is connected to the steering bracket 10 through a pivot shaft 19. This allows rotation of the tiller handle assembly 1 upward relative to the steering bracket 10, as indicated by the arrow A in FIG. 1.

The tiller handle assembly 1 has a throttle grip 12 disposed at its front end, and a shift lever 15 disposed rearward from the throttle grip 12. The throttle grip 12 preferably is connected to an intake system 101, including a throttle valve (not shown), of the engine 31 through a throttle cable 42, as described later. In other embodiments, however, the throttle grip 12 can interact with other components of the engine to vary the propulsion speed of the outboard motor 2.

The shift lever 15 is attached to a rotational shaft 54, at its base, to rotate forward and rearward. When the shift lever 15 is at its central position, a neutral mode (N) is selected. When it is tilted forward and rearward, modes of a transmission are shifted to a forward mode (F) and a reverse mode (R), respectively. The shift lever 15 is connected to a link mechanism 102 in the outboard motor 2 through a shift cable 51, as described later. The link mechanism 102, through the shift rod 36, causes the dog clutch to engage with one of the paired bevel gears of the gear mechanism 33 through the shift rod 36. The engagement of the dog with the bevel gear couples together the propeller shaft and the drive shaft, causing the propeller shaft to rotate in either a forward or reverse mode, depending upon which bevel gear is engaged.

Figure 2:
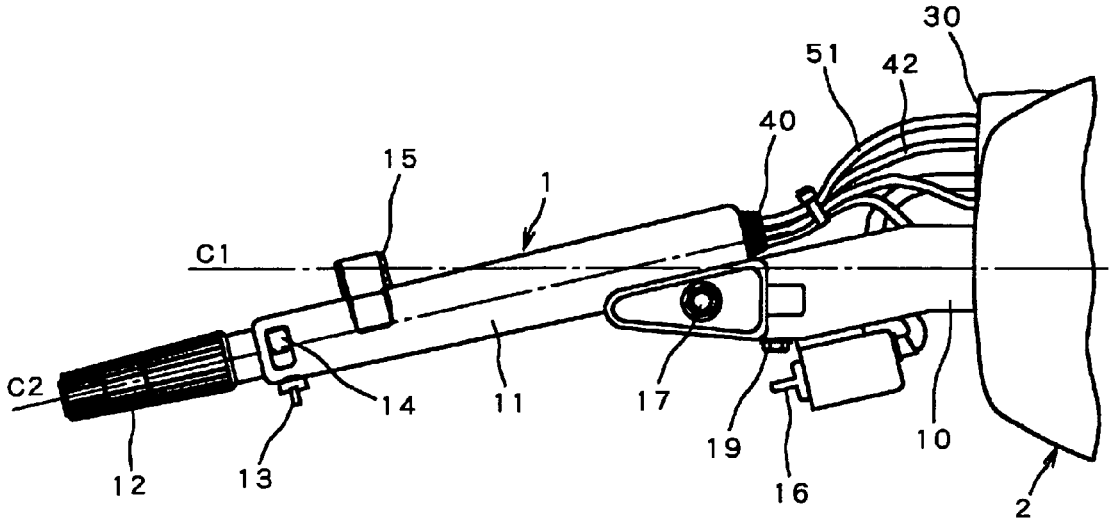
FIG. 2 is an enlarged top plan view of the tiller handle assembly of FIG. 1.

With reference to FIG. 2, the tiller handle assembly 1 has a steering handle body 11 of a rod-shaped, aluminum alloy casting or the like. The accelerator throttle grip 12 for opening and closing the throttle valve (not shown) of the intake system of the engine is mounted to the front end of the steering handle body 11 and is rotatably about its axis C2.

In the illustrated embodiment, the axis C2 of the steering handle body 11 is inclined to the port side with respect to the central axis Cl of the outboard motor 2, as seen in FIG. 2. The operator usually steers with the outboard motor 2 behind him/her while holding the throttle grip 12 of the tiller handle assembly 1 with his/her left hand. The steering handle body 11 can of course be angled toward the starboard side in other applications.

The throttle grip 12 preferably is a plastic or rubber member and is formed with recesses and projections (e.g., ribs) on its surface as appropriate to increase friction applied to an operator's palm so that his/her hand is inhibited from slipping off the grip.

The shift lever 15 is positioned at the tiller handle assembly 1 rearward from the throttle grip 12, namely, closer to the outboard motor 2 than the throttle grip 12. The operator selects any of forward, reverse, and neutral modes with the shift lever 15.

The steering handle body 11 is provided with various switches such as a throttle friction device 13 for regulating friction exerted on the throttle grip 12, a power tilt and trim switch (not shown) used for adjusting a tilt angle and a trim angle of the outboard motor 2, an idle speed control switch 14, a main switch 16 for turning the main power on/off, and a lanyard switch 17 for forcibly stopping the engine. A lanyard 4, to connect to an operator's arm or the like, is attached to the lanyard switch 17, as shown in FIG. 1. Incidentally, the idle speed control switch 14 and the main switch 16 are not shown in FIG. 1.

The base end of the tiller handle assembly I is formed with a cable lead-out opening 40. Various cables including the throttle cable 42 and the shift cable 51 are led out from the cable lead-out opening 40 into a cable lead-in opening 30 formed at the front end of the lower cowling 22 (FIG. 1).

Figure 3:
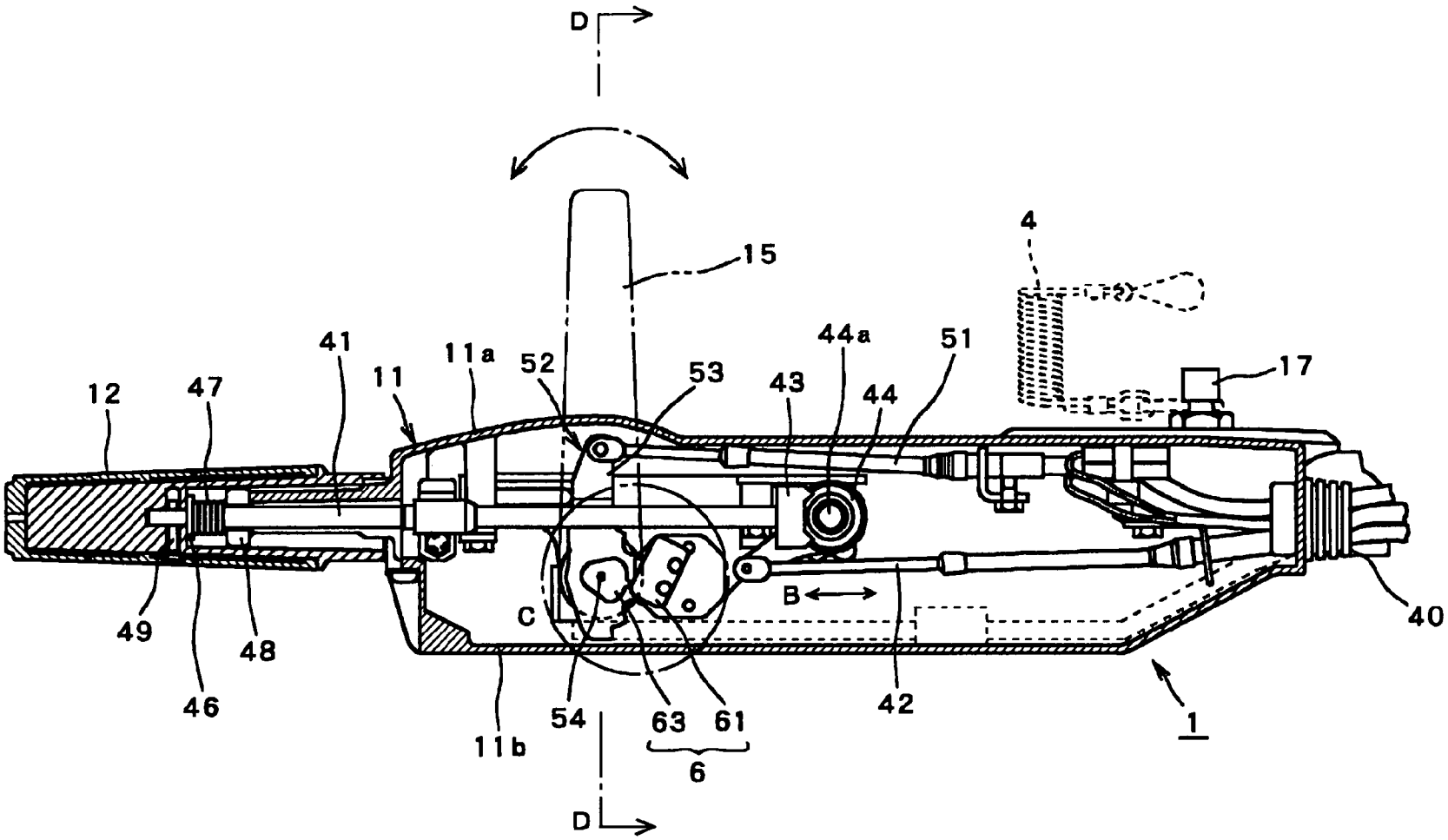
FIG. 3 is a cross-sectional view of the tiller handle assembly of FIG. 1 as viewed from the side.

FIG. 3 shows an inside structure of the tiller handle assembly 1. In this preferred embodiment, the steering handle body 11 is made up of an upper casing 11*a* and a lower casing 11*b* that together form an outside casing of the tiller handle assembly 1. The steering handle body 11 is formed as an aluminum alloy casting, for example. The inside of the steering handle body 11, which is surrounded by the upper casing 11*a* and the lower casing 11*b*, accommodates the throttle cable 42, the shift cable 51, lead wires for various switches, and the like.

The throttle grip 12 is connected to the front end of a throttle shaft 41 with a screw 49. Thus, when the throttle grip 12 is turned, the throttle shaft 41 turns together with the throttle grip 12.

A portion of the throttle shaft 41 close to its front end is retained by a retaining portion 48, and a spring 47, which is for urging the throttle shaft 41 in a certain direction, is located between the retaining portion 48 and a plate 46. When the throttle shaft 41 turns, a moving member 43 at an end of the throttle shaft 41 turns a turning support member 44 about its shaft 44*a*. This moves the throttle cable 42, which preferably is in the form of a push-pull cable, longitudinally as indicated by the arrow B. In such manner, rotation of the throttle shaft 41 is transmitted to the throttle cable 42 as longitudinal movement, which in turn opens and closes the throttle valve (not shown) of the intake system of the engine 31 mounted in the outboard motor 2 shown in FIG. 1. This regulates the volume of air intake and thus controls the output of the engine.

The shift lever 15 is attached rotatably in both the forward and rearward directions and moves relative to the steering handle body 11. The shift lever 15 and the front end of the shift cable 51 are connected through a shift transmission mechanism 52.

The shift transmission mechanism 52 includes a connection linkage 53 and the rotational shaft 54. The shift lever 15 at its base end is attached to or integrated with the rotational shaft 54 and rotates about the rotational shaft 54 within a specified range of motion so that the transmission is shifted among the forward, reverse, and neutral operational modes, as described above in connection with FIG. 1. The connection linkage 53 is attached to the rotational shaft 54, and the front end of the shift cable 51, which preferably is a push-pull cable, is connected to the connection linkage 53.

Operating the shift lever 15 causes the shift transmission mechanism 52 to longitudinally move the front end of the shift cable 51. The shift cable 51 is routed into the cable lead-in opening 30 (FIG. 2) of the outboard motor 2 from the cable lead-out opening 40 of the rear end of the tiller handle assembly 1 and is connected to the link mechanism 102 at the upper end of the shift rod 36 in the outboard motor 2 shown in FIG. 1. In the illustrated embodiment, when the shift lever 15 is moved forward, the boat is propelled forward, while when the shift lever 15 is moved rearward, the boat is propelled rearward. When the shift lever 15 is directed upward, a neutral operational mode is selected.

Figure 4:
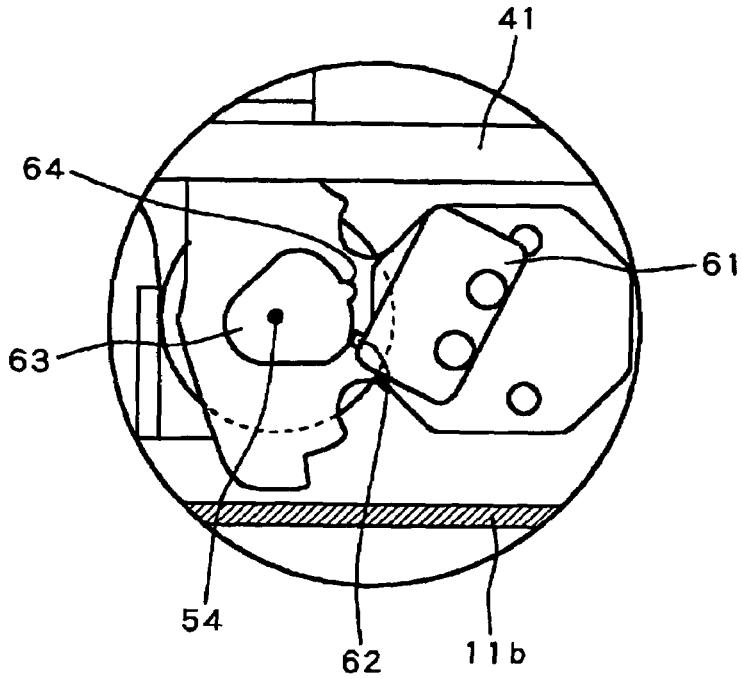
FIGS. 4(A) and 4(B) are enlarged views of the area within circle C shown in FIG. 3, with a shift lever moved between a drive position and a neutral position, respectively.
Figure 4:
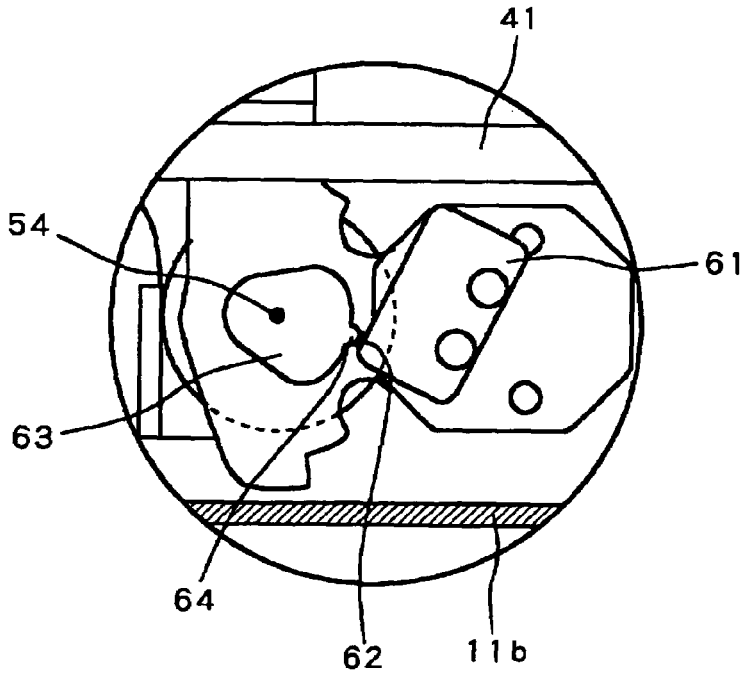

The inside of the steering handle body 11 is provided with a neutral switch 6. In the illustrated embodiment, the neutral switch 6 includes a switch body 61 with a switch button 62 (FIG. 4), and a cam 63 that functions as an actuator to depress the switch button 62 to actuate the switch. The neutral switch 6 preferably is located below the throttle shaft 41, which is provided generally within the center of the tiller handle assembly 1. The cam 63 is mounted to the rotational shaft 54 of the shift lever 15 and rotates about the rotational shaft 54 together with the shift lever 15. The switch body 61 is positioned rearward from the cam 63, namely, closer to the cable lead-out opening 40 than is the cam 63. The switch button 62 of the switch body 61 (FIG. 4) is disposed below the center of the rotational shaft 54 of the shift lever 15.

FIGS. 4(A) and 4(B) are explanatory views of operation of the neutral switch in accordance with the illustrated embodiment.

When the shift lever 15 is moved forward to its forward position, the cam 63 rotates counterclockwise about the rotational shaft 54, and thus a projection 64 of the cam 63 moves upward away from the switch button 62 of the switch body 61, so that the switch button 62 is not depressed, as shown in FIG. 4(A). That is, the neutral switch is not actuated (e.g., turned off). Similarly, when the shift lever 15 is moved to its reverse position, the cam 63 rotates clockwise about the rotational shaft 54, and thus the projection 64 of the cam 63 moves downward away from the switch button 62. Thus, the neutral switch is not actuated.

When the shift lever 15 is at its neutral position, the projection 64 depresses the switch button 62, as shown in FIG. 4(B), so that the neutral switch 6 is actuated (e.g., turned on).

Since the cam 63 has a turning axis coaxial with a turning axis of the shift lever 15 and rotates in connection with the shift lever 15, the cam 63 can correctly indicate the neutral position of the shift lever 15 correspondingly to operator's operation of the shift lever 15.

The neutral switch 6 is located rearward from the rotational shaft of the shift lever 54, namely, closer to the base end of the steering handle body 11 at which it is connected to the outboard motor 2. This makes a lead wire for the neutral switch 6 relatively short, thereby preventing complicated wiring. Further, since no lead wire runs by the rotational shaft 54 of the shift lever 15, the lead wire does not interfere with the rotation of the shift lever 15. This ensures reliable shift operations and reduces damage and deterioration of the lead wire.

Figure 5:
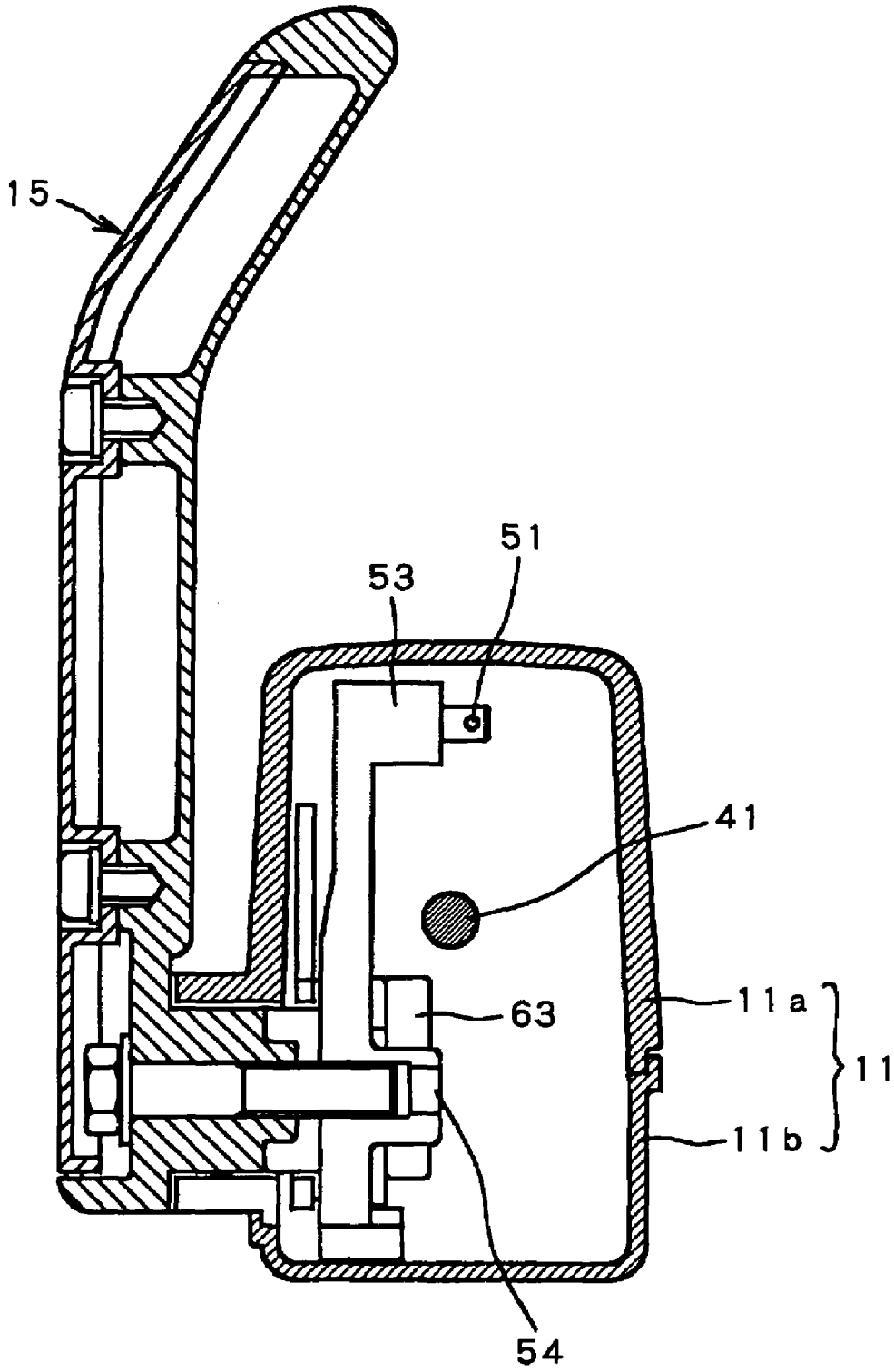
FIG. 5 is an enlarged cross-sectional view of the tiller handle assembly taken along the line D-D in FIG. 3

As best seen in FIG. 5, which is a sectional view of the tiller handle assembly, the steering handle body 11 is made up of the upper casing 11*a* of an inverted squared U-shape in section with a downward opening, and the lower casing 11*b* to cover the downward opening of the upper casing 11*a*. The assembly of the upper and lower casings 11*a*, 11*b* produces a tubular structure; however, the steering handle body can have other configurations with one or more hollows to house at least the neutral switch.

The shift lever 15 is attached to the rotational shaft 54. The connection linkage 53 and the cam 63 are also attached to the rotational shaft 54. The upper end of the connection linkage 53 is connected to an end of the shift cable 51, as best seen in FIG. 3.

As also seen in FIG. 3, the neutral switch 6 is disposed along the longitudinal direction of the steering handle body 11, below the throttle shaft 41, which is provided generally at the center within the steering handle body 11. Thus, adjustment to the cam 63 and to the neutral switch 6 can be easily made. The tiller handle assembly 1 simply is rotated about the shaft 19 as indicated by the arrow A (FIG. 1), and the lower casing 11*b* of the steering handle body 11 is removed from the upper casing 11*a* to expose these components of the tiller handle assembly 1. As such, maintenance is made easy because the neutral switch is positioned in front of a worker once the lower casing is removed from the upper casing after rotating the steering handle body upward. In addition, since the tiller handle assembly is located inside the boat, the operator can adjust the neutral switch on the water as well.

Figure 6:
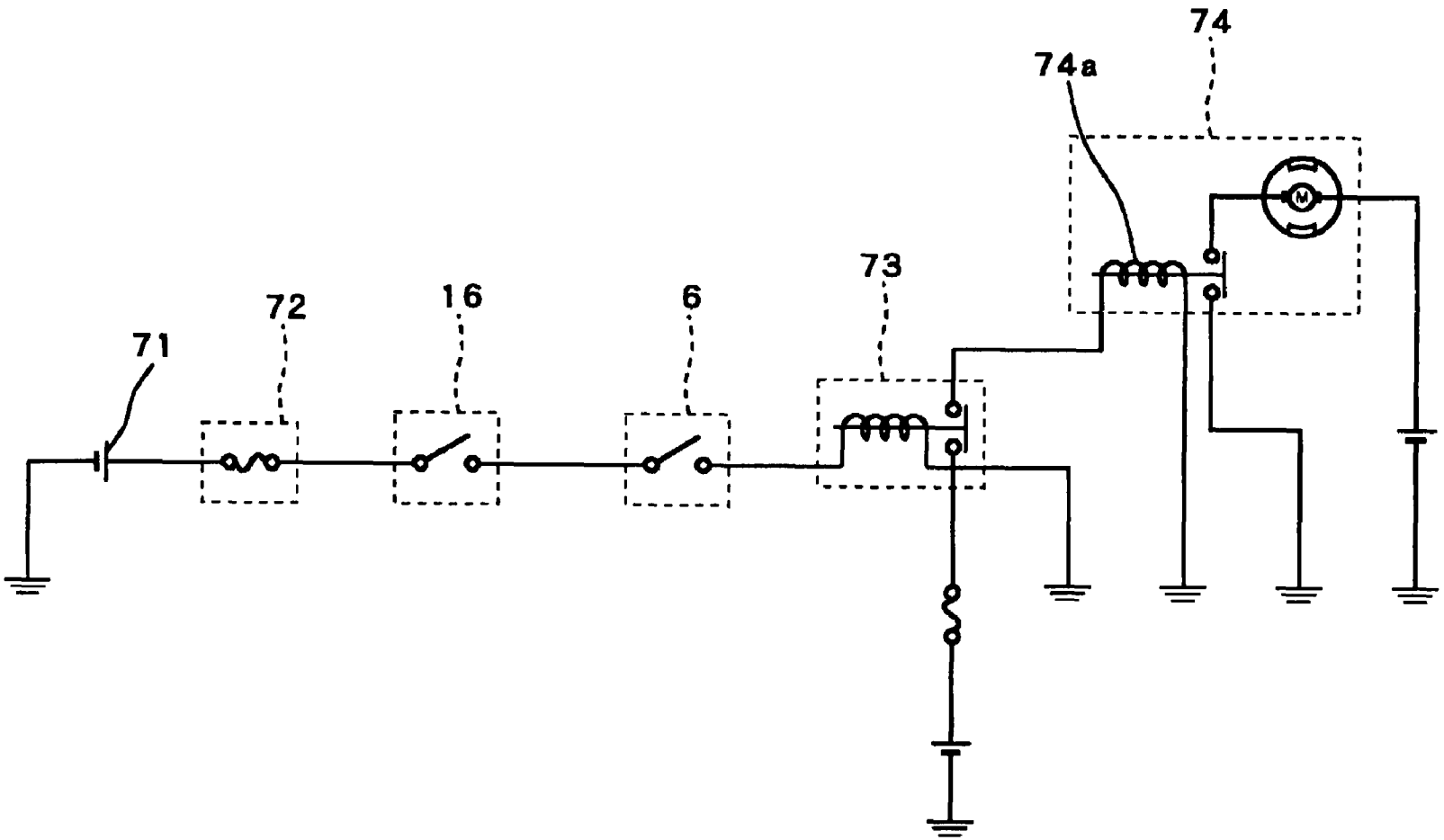
FIG. 6 is a circuit diagram incorporating a neutral switch of the present embodiment.

FIG. 6 illustrates a circuit diagram for a starter motor of the engine, which includes the neutral switch 6. In the illustrated embodiment, the neutral switch 6 is connected to the main switch 16 and a starter relay 73 in series. A battery 71 is connected to the main switch 16, the neutral switch 6, and the starter relay 73 through a fuse 72, in series. The starter relay 73 is connected to a starter motor 74 through a relay circuit 74*a*. This exemplary circuit configuration allows the supply of power to the starter motor 74 from the battery 71 to run the starter motor 74, only when the shift lever 15 is at its neutral position and the neutral switch 6 is actuated. In a more particular embodiment, power, which is supplied from the battery 71 when the main switch 16 is turned on and the neutral switch 6 is in an ON state (a neutral mode is selected), activates the starter relay 73 through the fuse 72 to start the starter motor 74. Since the neutral switch 6 is not activated when the shift lever 15 is at its forward or reverse position, the starter relay 73 is not activated and thus the starter motor 74 does not start.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. For example, the cam can be shaped so as to actuate the switch when the shift lever is located at a position other than its neutral position and the absence of a signal from the neutral switch can be used to complete the starter motor circuit. Additionally, other types of sensors and switches can also be used in place of the above-described micro switch to determine the position of the shift lever, such as, for example, but without limitation, potentiometers, Hall-effect switches and the like.

While a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. A tiller handle assembly for an outboard motor comprising an elongated steering handle having a longitudinal axis, the steering handle being configured to be pivotally connected to the outboard motor and to extend outward from the outboard motor, a throttle grip attached to a front end of the steering handle and being rotatable generally about the longitudinal axis, a shift lever rotatably movable about a rotational axis to select an operational mode of the outboard motor among forward, neutral and reverse operational modes, a shift cable operatively linked to the shift lever and adapted to communicate the selected operational mode from the steering handle to the outboard motor, and a neutral switch disposed inside the steering handle and arranged to determine at least when the shift lever lies in a position corresponding to the neutral operational mode for the outboard motor, wherein the shift cable is disposed above the rotational axis of the shift lever and the neutral switch is disposed below the rotational axis of the shift lever.

2. The tiller handle assembly of claim 1, wherein the steering handle comprises an upper casing of a squared U-shape in section with a downward opening and a lower casing to cover the downward opening of the upper casing.

3. The tiller handle assembly of claim 1, wherein the neutral switch is disposed on a side of the rotational shaft of the shift lever generally opposite the throttle grip.

4. The tiller handle assembly of claim 3, wherein the neutral switch includes a cam adapted to rotate together with the shift lever about an axis of the rotational shaft, and a switch body having a switch button arranged to contact with the cam, the switch button being disposed below the center of the rotational shaft of the shift lever.

5. A tiller handle assembly for an outboard motor comprising a steering handle having a generally hollow body, a throttle grip attached to a front end of the steering handle, a shift mechanism coupled to the steering handle, the shift mechanism including a moveable operator that can be moved at least between two positions, one of the positions corresponding to a drive operational mode of the outboard motor and the other position corresponding to a neutral operational mode of the outboard motor, an operational mode linkage attached to the moveable operator and configured to communicate the position of the moveable operator out of the steering handle, and a sensor device configured to engage the moveable operator so as to determine whether the operator is disposed in one of the two positions, the sensor device being disposed within the hollow body of the steering handle and in a bottom portion of the steering handle, a portion of the operational mode linkage within the hollow body being disposed in a top portion of the steering handle.

6. The tiller handle assembly of claim 5, wherein the operator is movable between three positions corresponding to forward, neutral and reverse operational modes of the outboard motor.

7. The tiller handle assembly of claim 5, wherein the operator is a shift lever that rotates about support shaft disposed within the hollow body of the steering handle.

8. The tiller handle assembly of claim 7, wherein the sensor device comprises a cam coupled to the shift lever so as to rotate therewith, and a switch arranged to cooperate with the cam.

9. The tiller handle assembly of claim 8, wherein the switch is disposed generally below the center of the support shaft.

10. The tiller handle assembly of claim 5, wherein the hollow body is generally tubular with a generally rectangular configuration in cross-section.

11. The tiller handle assembly of claim 10, wherein the hollow body comprises an upper U-shaped channel disposed so as to open downward and a lower plate covering a lower end of the upper U-shaped channel.

12. The tiller handle assembly of claim 5, wherein the linkage interconnects the operator with a shift device disposed within a cowling of the outboard motor.

13. The tiller handle assembly of claim 5 additionally comprising at least one throttle cable that is coupled to the throttle grip and extends from the tiller handle assembly into the outboard motor.

14. The tiller handle assembly of claim 5, wherein the steering handle includes a coupling at one end that is configured to pivotally couple the steering handle to the outboard motor so as to rotate about an axis that lies generally normal to a longitudinal axis of the steering handle.

15. The tiller handle assembly of claim 13, wherein a portion of the throttle cable within the steering handle is disposed between the operational mode linkage and the sensor device.

* * * * *